US008335453B2

(12) United States Patent
Nishiuwatoko

(10) Patent No.: US 8,335,453 B2
(45) Date of Patent: Dec. 18, 2012

(54) ELECTROPHOTOGRAPHIC IMAGE FORMING APPARATUS

(75) Inventor: Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 398 days.

(21) Appl. No.: 12/693,291

(22) Filed: Jan. 25, 2010

(65) Prior Publication Data

US 2010/0189474 A1 Jul. 29, 2010

(30) Foreign Application Priority Data

Jan. 27, 2009 (JP) ..... 2009-015416

(51) Int. Cl.
*G03G 15/00* (2006.01)

(52) U.S. Cl. ..... 399/110; 399/113

(58) Field of Classification Search ..... 399/110, 399/113, 116, 121, 167
See application file for complete search history.

(56) References Cited

U.S. PATENT DOCUMENTS 6,708,011 B2 3/2004 Nomura
7,526,227 B2 4/2009 Sato
2006/0228131 A1* 10/2006 Kimura et al. ..... 399/111

* cited by examiner

*Primary Examiner* — Walter L Lindsay, Jr.
*Assistant Examiner* — Barnabas Fekete
(74) *Attorney, Agent, or Firm* — Canon U.S.A., Inc., IP Division

(57) ABSTRACT

An electrophotographic image forming apparatus for forming an image on a recording medium includes an apparatus body having an endless belt incorporated therein configured to transfer toner images formed on a plurality of image bearing members to the recording medium, and a supporting member configured to support the plurality of image bearing members and to be slidable between inner and outer positions of the apparatus body along the arranged direction of the plurality of image bearing members, wherein when the supporting member slides between the inner and outer positions of the apparatus body while at least one of the plurality of image bearing members is in contact with the belt, a force is applied to the belt to rotate the belt along the moving direction of the supporting member.

11 Claims, 9 Drawing Sheets

ELECTROPHOTOGRAPHIC IMAGE FORMING APPARATUS

BACKGROUND OF THE INVENTION

1. Field of the Invention

The present invention relates to an image forming apparatus using electrophotographic technique.

2. Description of the Related Art

In-line type/tandem type image forming apparatuses including a plurality of image forming stations arranged approximately in line are known as electrophotographic image forming apparatuses (hereinafter, referred to as image forming apparatus) for forming multi-colored or full-colored images using electrophotographic technique.

In such image forming apparatuses, the image forming stations are each used to form images indifferent colors (e.g., yellow, magenta, cyan, and black), and the resulting monotone images are superposed to one another to form a multicolor image, which is transferred and fixed to a recording material to obtain an image.

The image forming stations are each configured with process units each including an image bearing member (hereinafter, referred to as photosensitive drum), a developer supply unit, a developing unit, a charging unit, a cleaning unit, an exposure unit, and a transfer unit. Some apparatuses are known to have a part of the process units in the form of a cartridge replaceable by a user for enhancing maintainability of the apparatuses.

Specific examples commonly used include a developing device configured as a replaceable development cartridge with developer therein, and a detachable process cartridge configured with a photosensitive drum, a developer supply unit, a developing unit, a charging unit, and a cleaning unit.

An intermediate transfer member in the form of an endless belt (with no ends) is known as a unit configured to transfer monotone images to a recording material. In apparatus having the unit, monotone images are primarily transferred to the intermediate transferring member one by one, and the resulting multicolor images superposed on the intermediate transferring member are secondarily transferred to a recording material.

A recording material conveyance member in the form of an endless belt (with no ends) is known as another unit configured to transfer monotone images to a recording material. In such an apparatus, recording materials are conveyed to each of image forming stations one by one, and the resulting images are directly transferred and superposed on the recording material. Hereinafter, the intermediate transfer member and the recording material conveyance member are collectively called an endless belt.

Some image forming apparatuses described above include a supporting member (hereinafter, referred to as a drawer) that is movable between inner and outer positions of the body of the apparatus for enhancing maintainability of the apparatus, the drawer being configured with image forming stations arranged therein (hereinafter, referred to as a drawer structure). A user pulls out the drawer for maintenance of the apparatus.

In the above described image forming apparatuses, any damage on photosensitive drum and endless belt (especially on an intermediate transferring member) may cause poor image quality. To prevent the damage on photosensitive drum and endless belt, some structures are discussed for an image forming apparatus having a drawer structure, including a structure in which a drawer is pulled out after a photosensitive member is separated from an endless belt (U.S. Pat. No. 6,708,011), and another structure in which a drawer member is pulled out in a direction oblique to the direction of separation of a photosensitive member from an endless belt (U.S. Pat. No. 7,526,227).

However, in a structure in which a drawer is pulled out after a photosensitive member is separated from an endless belt (e.g., the structure in U.S. Pat. No. 6,708,011), the direction of the separation of the photosensitive member from the endless belt is generally orthogonal to the drawing direction of the drawer, which sacrifices operability.

For the separation of the photosensitive member from the endless belt, an exposure apparatus for example is disposed in the separation direction, and the separation is performed in a space that is prepared in advance between the drawer member and the exposure apparatus. This hinders downsizing of the apparatus.

In the structure in which a drawer member is pulled out in a direction oblique to the direction of separation of a photosensitive member from an endless belt (U.S. Pat. No. 7,526,227), the drawer member is linearly operated for enhancing operability. However, the linear operation requires a larger space, thus hindering downsizing of the apparatus.

SUMMARY OF THE INVENTION

The present invention is directed to an image forming apparatus in which a supporting member that supports an electrophotographic photosensitive member is slidable relative to a body of the apparatus having an endless belt, capable of downsizing the apparatus and suppressing sliding wear between the photosensitive member and the endless belt.

According to an aspect of the present invention, an electrophotographic image forming apparatus for forming an image on a recording medium includes an apparatus body having an endless belt incorporated therein configured to transfer toner images formed on a plurality of image bearing members to the recording medium, and a supporting member configured to support the plurality of image bearing members and to be slidable between inner and outer positions of the apparatus body along the arranged direction of the plurality of image bearing members, wherein when the supporting member slides between the inner and outer positions of the apparatus body while at least one of the plurality of image bearing members is in contact with the belt, a force is applied to the belt to rotate the belt along the moving direction of the supporting member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
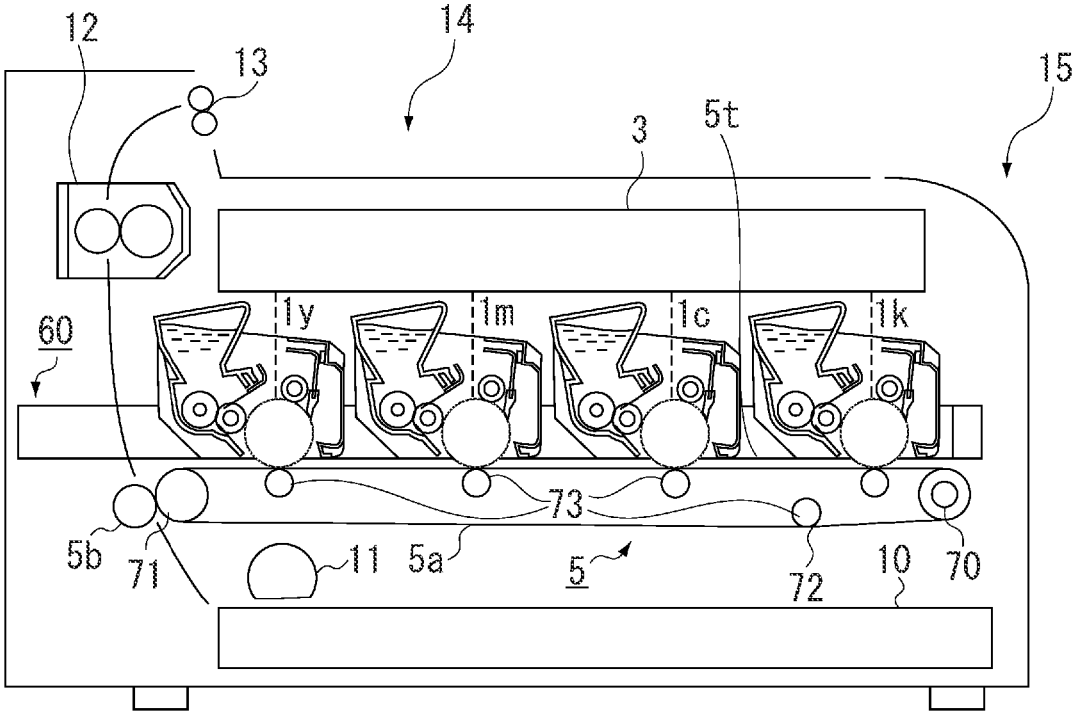
FIG. 1 is a cross sectional view illustrating an electrophotographic image forming apparatus with process cartridges.
Figure 2:
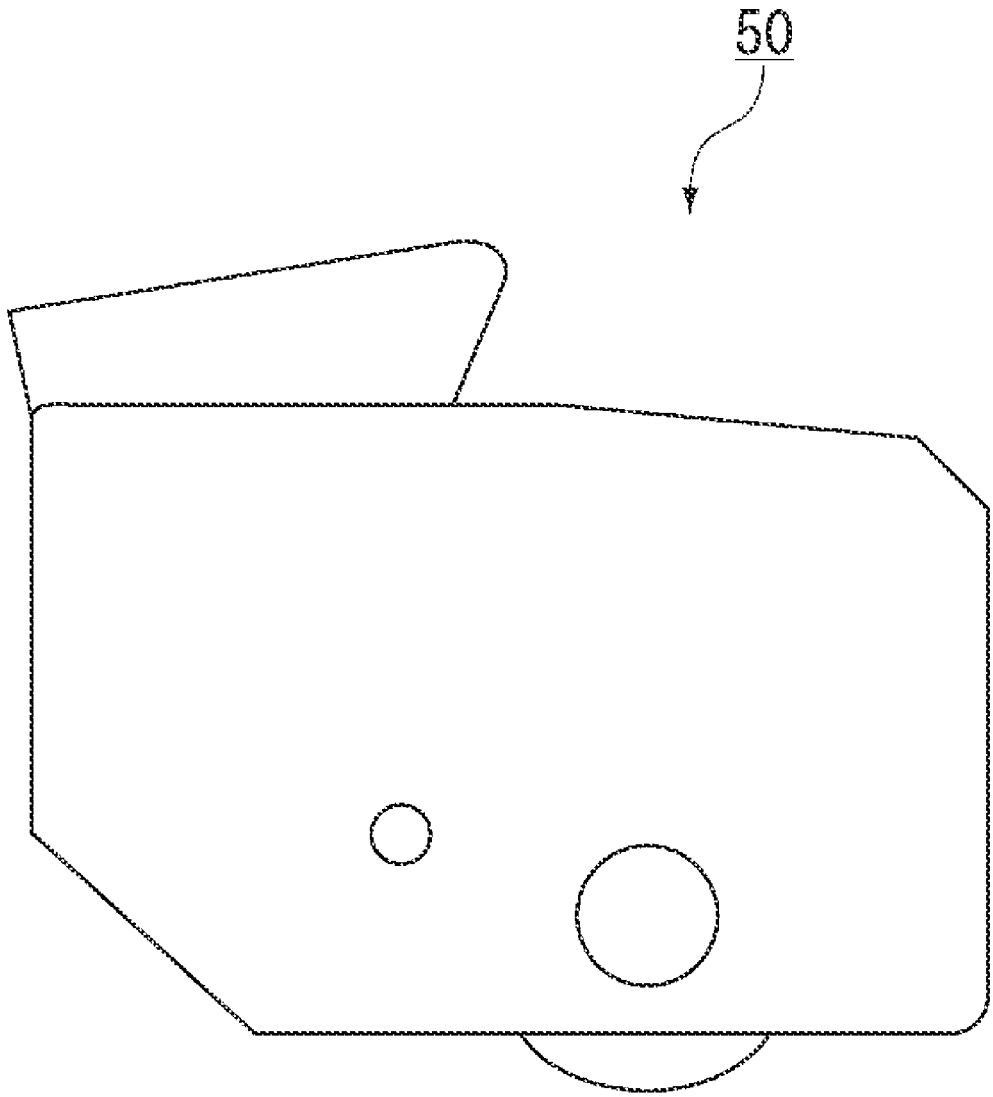
FIG. 2 is a side view illustrating a process cartridge.
Figure 3:
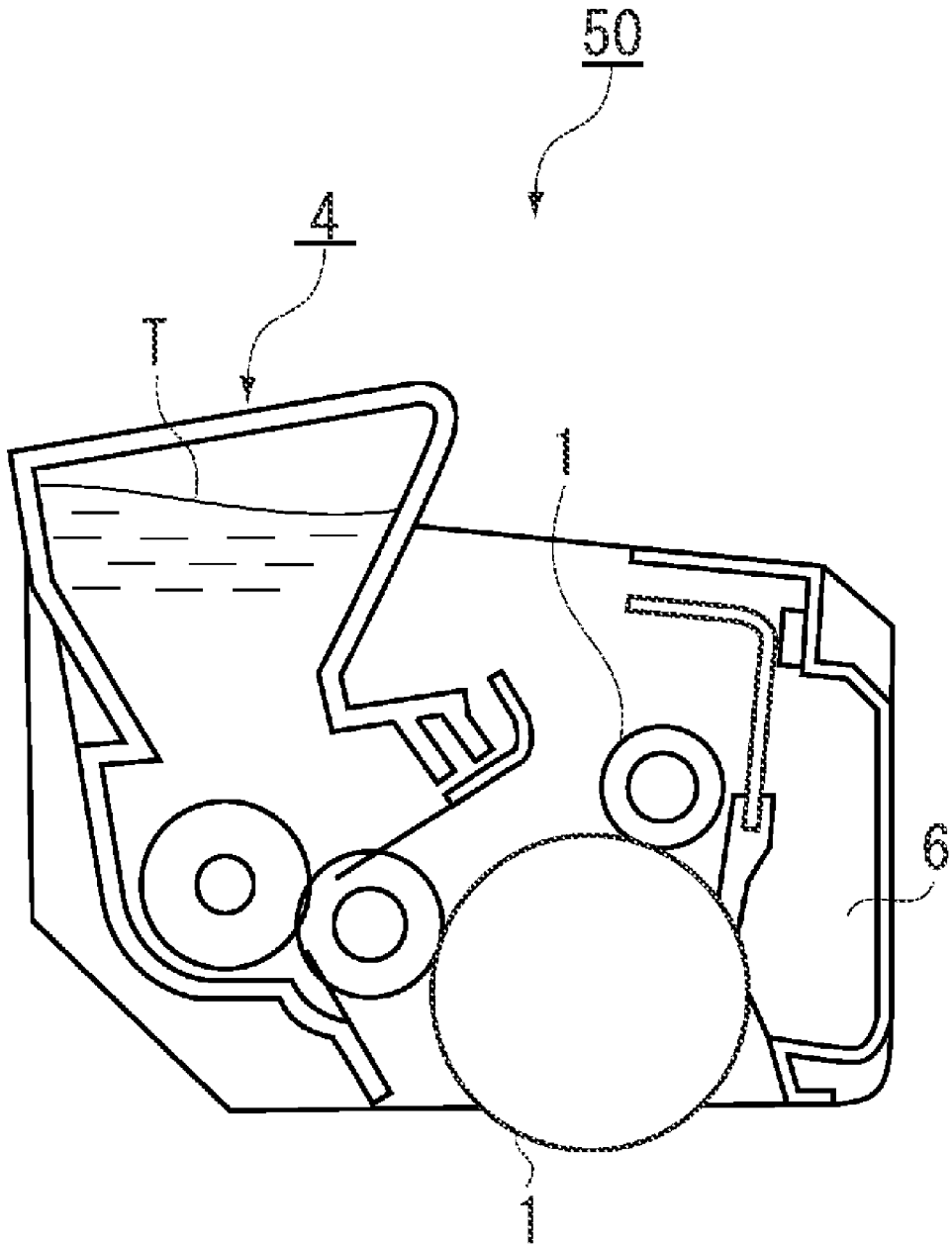
FIG. 3 is a cross sectional view illustrating a process cartridge.
Figure 4A:
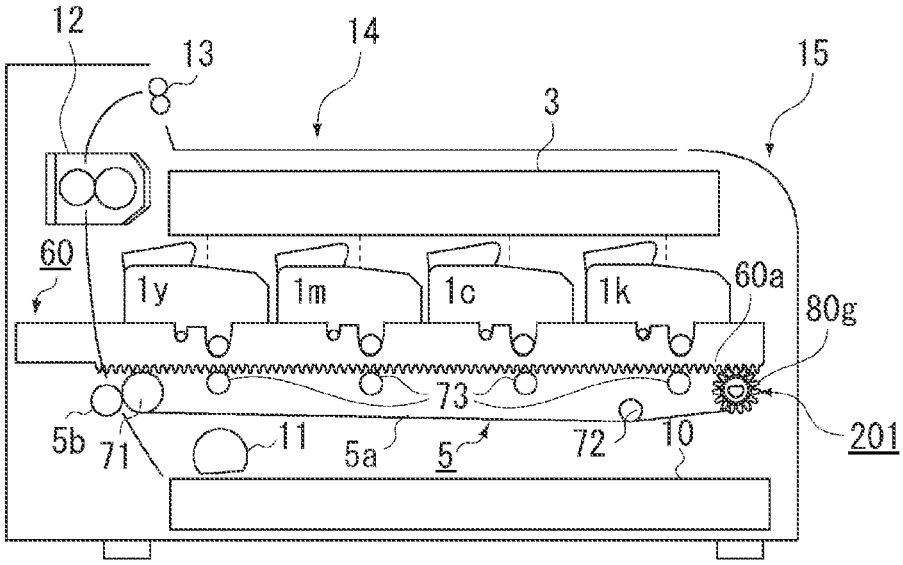
FIG. 4A is a cross sectional view illustrating a part of an electrophotographic image forming apparatus of a first exemplary embodiment.
Figure 4B:
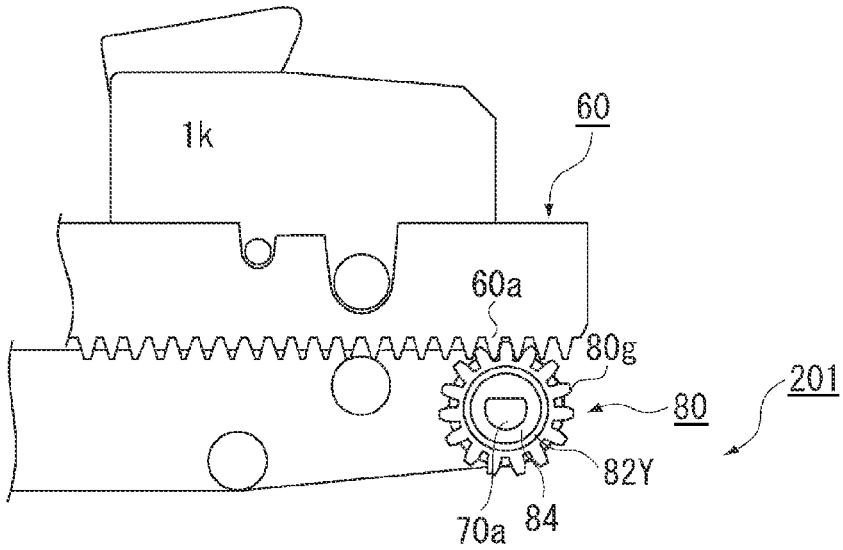
FIG. 4B is an enlarged view of the part.
Figure 5A:
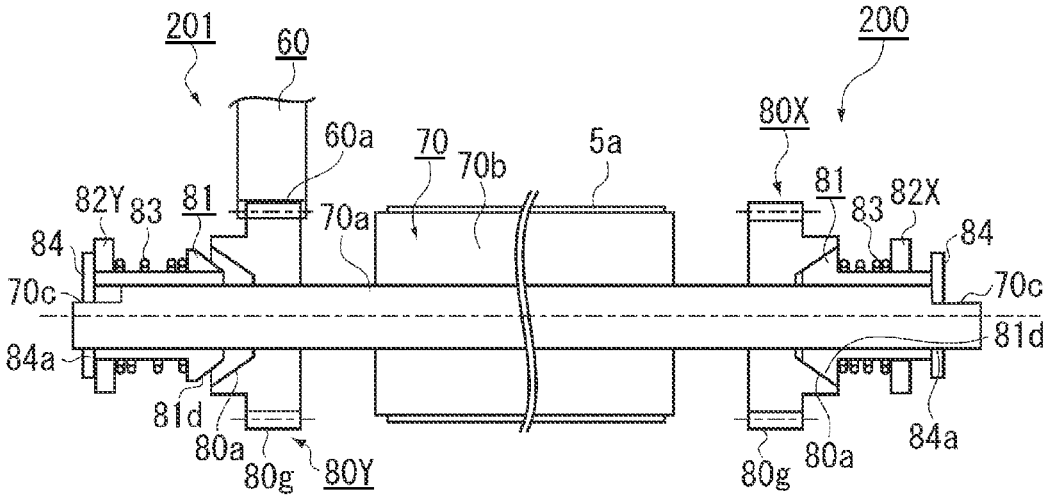
FIGS. 5A, 5B and 5C are longitudinal cross sectional views illustrating a transfer device according to a first exemplary embodiment.
Figure 5B:
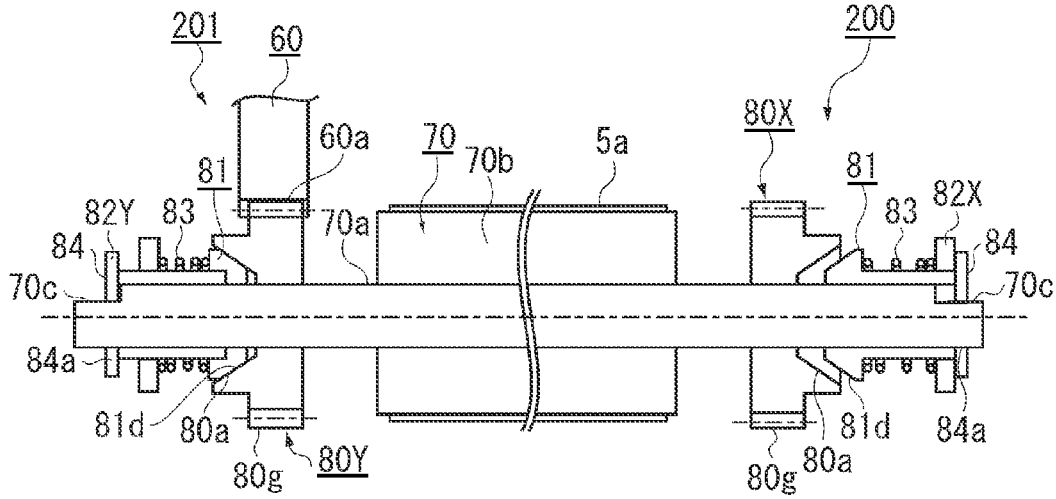
Figure 5C:
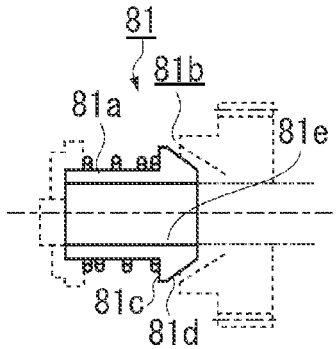
Figure 6A:
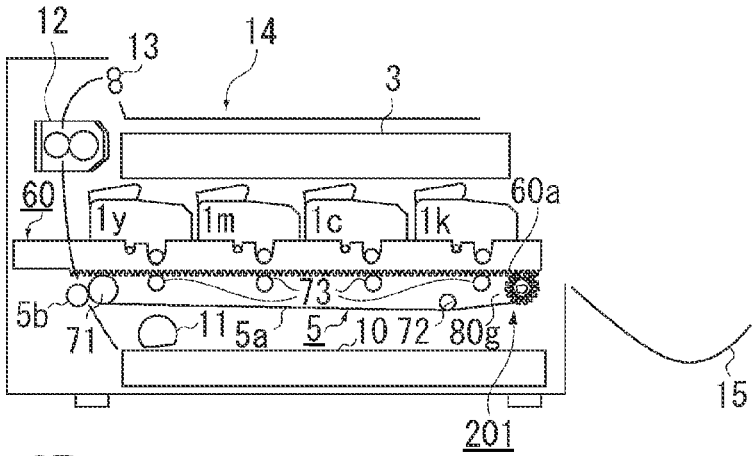
FIGS. 6A, 6B and 6C are partial cross sectional views illustrating an electrophotographic image forming apparatus according to the first exemplary embodiment.
Figure 6B:
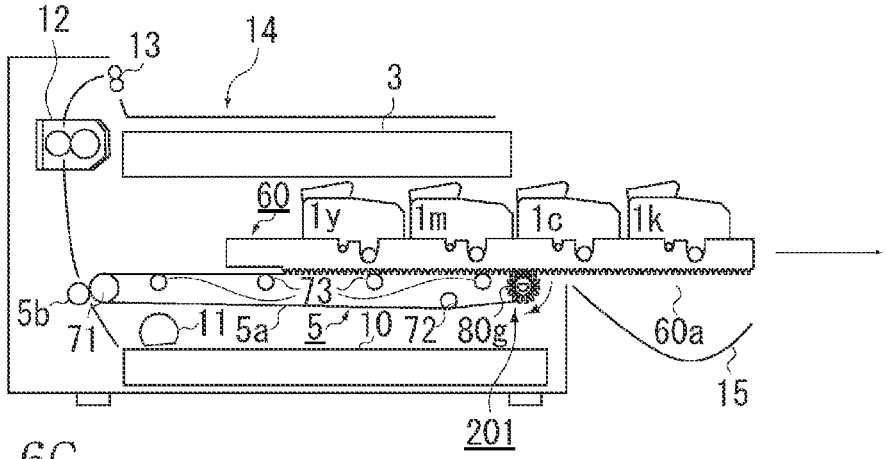
Figure 6C:
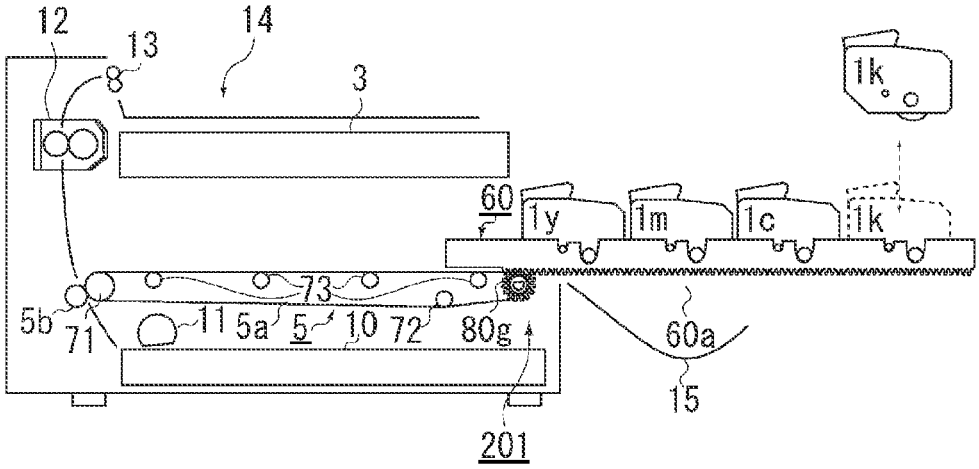
Figure 7A:
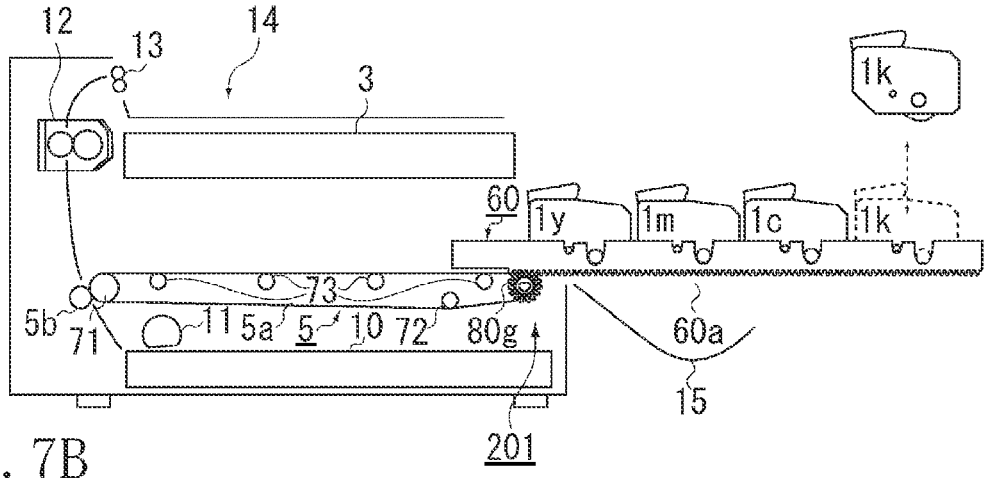
FIGS. 7A, 7B and 7C are cross sectional views illustrating an electrophotographic image forming apparatus according to the first exemplary embodiment.
Figure 7B:
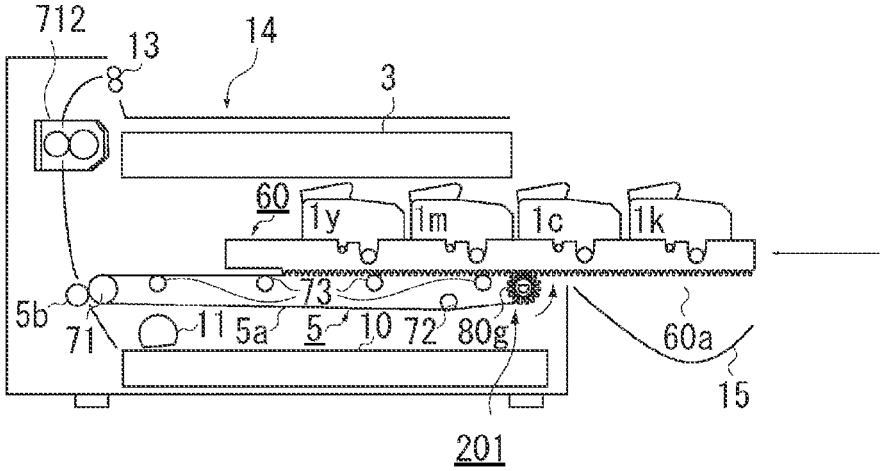
Figure 7C:
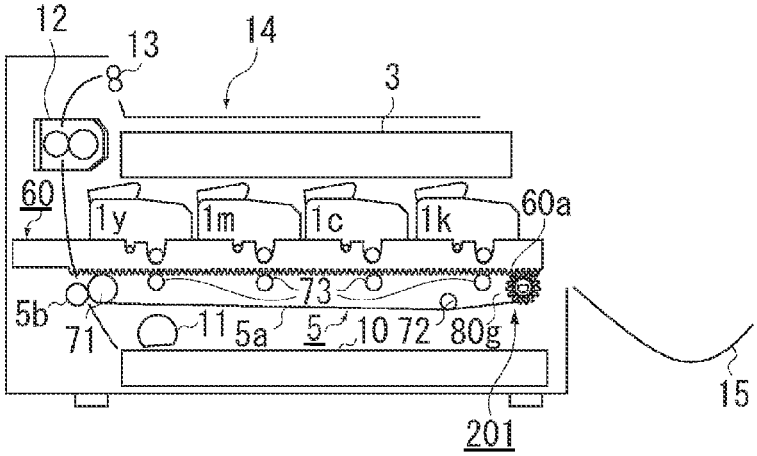

FIG. 1 is a cross sectional view illustrating an electrophotographic image forming apparatus with process cartridges mounted thereto. FIG. 2 is a side view illustrating a process cartridge. FIG. 3 is a cross sectional view illustrating a process cartridge. FIGS. 4A and 4B are partial cross sectional views of the electrophotographic image forming apparatus, illustrating a drawer mechanism. FIGS. 5A, 5B and 5C are longitudinal cross sectional views illustrating a driving mechanism of a transfer device. FIGS. 6A, 6B and 6C and FIGS. 7A, 7B and 7C are partial cross sectional views of the electrophotographic image forming apparatus, illustrating operations of the drawer mechanism.

An image forming apparatus according to a first exemplary embodiment includes an apparatus body 100 of an electrophotographic image forming apparatus, a drawer member 60 serving as a supporting member movable relative to the apparatus body 100, and process cartridges 50 (50*y*, 50*m*, 50*c*, and 50*k*) detachable from the drawer member 60. The apparatus body 100 includes a recording sheet cassette 10, a sheet feeding roller 11, an exposure device 3, a transfer device 5, a fixing device 12, a sheet discharge roller 13, a sheet discharge tray 14, and a door 15. The drawer member 60 is supported by the apparatus body 100 to be slidable between inner and outer positions of the apparatus body 100.

The process cartridges 50 (50*y*, 50*m*, 50*c*, and 50*k*) each include an electrophotographic photosensitive drum 1 as an image bearing member (hereinafter, referred to as "photosensitive drum"), a charging device 2, a developing device 4, and a cleaning device 6.

The developing devices 4*y*, 4*m*, 4*c*, and 4*k* contain yellow, magenta, cyan, and black toner T, i.e., developers, therein respectively.

The apparatus body 100 is provided with a driving motor (not illustrated) in a manner that, in image forming, driving force can be transmitted to the process cartridges 50 via cartridge driving couplings (not illustrated). The cartridge driving couplings are engaged with the process cartridges 50 while the door is closed, and disengaged therefrom while the door is opened.

In image formation, the photosensitive drums 1 are driven to rotate counter-clockwise in FIG. 1. In the state illustrated in FIG. 1, the photosensitive drums 1 are each surrounded by the charging device 2, the exposure device 3, the developing device 4, the transfer device 5, and the cleaning device 6, in this order along the direction of the rotation of the photosensitive drums 1.

In image formation, first, the rotating photosensitive drums 1 are uniformly charged by the charging device 2. Then, the exposure device 3 selectively performs exposure based on image information to form electrostatic latent images on the outer surfaces of the photosensitive drums 1. The electrostatic latent images are visualized with the toner T, i.e., a developer, by the developing devices 4 as toner images.

At this stage, an yellow toner image is formed by the process cartridge 50*y*, a magenta toner image is formed by the process cartridge 50*m*, a cyan toner image is formed by the process cartridge 50*c*, and a black toner image is formed by the process cartridge 50*k*. These toner images are all superposed on a transfer belt 5*a* of the transfer device 5.

The recording sheet is supplied between the transfer belt 5*a* and a secondary transfer roller 5*b* from the recording sheet cassette 10 by the sheet feeding roller 11 at a timing. The superposed toner images formed on the transfer belt 5*a* are secondarily transferred to the recording sheet at the nip between the transfer belt 5*a* and the secondary transfer roller 5*b*.

The recording sheet is further conveyed to the fixing device 12, where the toner image is fixed on the recording sheet by pressing and heating. Finally the recording sheet is discharged using a sheet discharge roller 13 to a sheet discharge tray 14.

After transferred the toner images to the transfer belt 5*a* of the transfer device 5, the photosensitive drums 1 are each conveyed to the cleaning device 6. At the cleaning device 6, the residual toner remaining on the photosensitive drums 1 after the transfer is removed to use the photosensitive drums 1 again in the processes starting from the charging for image formation.

The transfer device 5 includes, in addition to the transfer belt 5*a* in the form of an endless belt and the secondary transfer roller 5*b*, a first suspension roller 70, a second suspension roller 71, a tension roller 72, and primary transfer rollers 73 (73*y*, 73*m*, 73*c* and 73*k*). The first suspension roller 70 is configured with a first suspension roller shaft 70*a* and a rubber layer 70*b*. The first suspension roller shaft 70*a* has D-cut portions 70*c* at both ends thereof.

The transfer belt 5*a* is suspended so that an almost flat primary transfer surface 5*t* is provided between the first suspension roller 70 and the second suspension roller 71, and is in contact with the photosensitive drums 1 (1*y*, 1*m*, 1*c*, 1*k*) on the primary transfer surface side.

The first suspension roller shaft 70*a* is provided with a drive-transmission clutch mechanism 200 at one end thereof (on the back side in FIG. 1, and on the right side in FIGS. 5A and 5B), and a tray-coupling clutch mechanism 201 on the other end (on the front side in FIG. 1, and on the left side in FIGS. 5A and 5B). The drive transmission clutch mechanism 200 and the tray-coupling clutch mechanism 201 are each configured with a transferring gear 80 (a transfer gear 80X on the drive transmission side, and a gear 80Y on the tray coupling side), a clutch cone 81, a ring 82 (a ring 82X on the drive transmission side, and a ring 82Y on the tray coupling side), a clutch spring 83, and a stopper ring 84.

The transferring gears 80 each have a gear surface 80*g* and a conical concave clutch surface 80*a*. The transferring gears 80 are each supported by a control member (not illustrated) to be fixed in the axial direction thereof and rotatable relative to the first suspension roller shaft 70*a*.

The transfer gear 80X on the drive transmission side of the drive transmission clutch mechanism 200 is engaged with an array of gears (not illustrated) for transmission of driving force from a motor during image forming operations. The gear 82Y on tray-coupling side of the tray-coupling clutch mechanism 201 is engaged with a drawer rack 60*a*, which will be described later.

The gear 80Y on the tray-coupling side of the tray-coupling clutch mechanism 201 includes a gear portion having a pitch radius that is approximately equal to the sum of the radius of the rubber layer 70*b* of the first suspension roller 70 and the thickness of the transfer belt 5*a*.

The clutch cones 81 each include a shaft portion 81*a* and a cone portion 81*b* at one end of the shaft portion 81*a*. The cone portion 81*b* is configured with a spring contact surface 81*c* orthogonally extending from the shaft portion 81*a*, and a conical convex clutch surface 81*d* that is coaxial with the shaft portion 81*a* and opposite to the shaft portion 81*a*.

Furthermore, the clutch cones 81 each has a through-hole 81*e* that is coaxial with the shaft portion 81*a*, in which the first suspension roller shaft 70*a* can be inserted. Into each of the shaft portions 81*a* of the clutch cones 81, the clutch spring 83, the ring 82, and the stopper ring 84 are assembled in this order. The ring 82 is slidable relative to the shaft portion 81*a*, and the clutch spring 83 is disposed between the spring contact surface 81*c* and the ring 82.

The stopper ring 84 has an outer diameter larger than that of the shaft portion 81*a*, and has a D-cut hole 84*a* formed centrally thereof to engage the D-cut portion 70*c* of the first suspension roller shaft 70*a*.

On the other end of the shaft portion 81*a*, the stopper ring 84 is integrally fixed to the clutch cone 81 so that the through-hole 81*e* of the clutch cone 81 is coaxial with the D-cut hole 84*a* of the stopper ring 84, and functions to prevent disassemble of the clutch springs 83 and the ring 82.

The clutch cones 81 each have the clutch springs 83, the ring 82, and the stopper ring 84 assembled thereto. The clutch cones 81 are assembled to the first suspension roller shaft 70*a* so that the convex clutch surface 81*b* is opposed to the concave clutch surface 80*a* and the D-cut hole 84*a* engages the D-cut portion 70*c* therein.

This makes the clutch cones 81 integrally can rotate with the first suspension roller shaft 70*a* in the rotation direction of the first suspension roller shaft 70*a*, and slidable in the axial direction of the first suspension roller shaft 70*a*.

The rings 82 (the ring 82X on the drive transmission side, and the ring 82Y on the tray coupling side) are controlled in the axial direction of the first suspension roller shaft 70*a* by a mechanism (not illustrated) to be positioned as illustrated in FIG. 5A while the door 15 is closed, and positioned as illustrated in FIG. 5B while the door 15 is opened.

More specifically, while the door 15 is closed, as illustrated in FIG. 5A, the clutch spring 83 is compressed on the side of the drive transmission clutch mechanism 200, and the ring 82X on the drive transmission side is controlled to be positioned to cause the convex clutch surface 81*b* of the clutch cone 81 to be press-contacted against the concave clutch surface 80*a* of the transferring gear 80X on the drive transmission side.

At the same time, the ring 82Y on the tray-coupling side is controlled to be positioned so that the convex clutch surface 81*b* of the clutch cone 81 on the tray-coupling clutch mechanism 201 side is completely separated from the concave clutch surface 80*a* of the transferring gears 80Y on the tray-coupling side.

On the other hand, while the door 15 is opened, as illustrated in FIG. 5B, in the drive transmission clutch mechanism 200, the ring 82X is controlled to be positioned so that the convex clutch surface 81*b* of the clutch cone 81 is completely separated from the concave clutch surface 80*a* of the transferring gears 80X on the drive transmission side.

At the same time, on the tray-coupling clutch mechanism 201 side, the clutch spring 83 is compressed, and the ring 82Y on the tray-coupling side is controlled to be positioned to cause the convex clutch surface 81*b* of the clutch cone 81 to be press-contacted against the concave clutch surface 80*a* of the transferring gear 80Y on the tray-coupling side.

The first suspension roller 70 is coupled to the motor using the gear array while the door is closed, and drives the transfer belt 5*a* for image formation by the above described processes. While the door is opened, the first suspension roller 70 is coupled to the drawer rack 60*a*.

The drawer member 60 is supported movable between the inner and outer positions of the apparatus body. More specifically, the drawer member 60 can be drawn almost parallel to the primary transfer surface 5*t* of the transfer belt 5*a* and almost linearly, which eliminates the space required for the separation of the drawer member 60 from the transfer belt 5*a*.

Through an operation of the drawer member 60 by a user, the photosensitive drums 1 move while being in contact with the transfer belt 5*a*, and as described above, the drawer rack 60*a* is meshed with the transferring gears 80X on the tray-coupling side.

In addition, the gear 80X on the tray-coupling side includes a gear portion having a pitch radius that is almost equal to the sum of the radius of the rubber layer 70*b* of the first suspension roller 70 and the thickness of the transfer belt 5*a*.

Thus, with the operation of the drawer member 60, the transfer belt 5*a* is driven at a speed almost equal to the moving speed of the drawer member 60, that is, each of the photosensitive drums 1. This maintains the relative positional relationship between the transfer belt 5*a* and the photosensitive drums 1, minimizing the sliding wear between the transfer belt 5*a* and the photosensitive drums 1.

As described above, the image forming apparatus of this exemplary embodiment includes an apparatus body having the transfer belt 5*a* incorporated therein for transferring toner images on the plurality of photosensitive drums 1 to a recording medium, and the drawer member 60 that supports the plurality of photosensitive drums 1 and is slidable between inner and outer positions of the apparatus body in the direction of the array of the plurality of photosensitive members.

The image forming apparatus is provided with a mechanism for applying a force to the transfer belt 5*a* to cause the transfer belt 5*a* to rotate along the moving direction of the drawer member 60 while the drawer member 60 is sliding between positions of the inside and outside of the apparatus body. This configuration minimizes the sliding wear between the transfer belt 5*a* and the photosensitive drums 1 even when the drawer member 60 slides with the transfer belt 5*a* being in contact with any of the plurality of photosensitive drums 1.

The configuration also eliminates the space that is required to move the drawer member 60 for separation of the plurality of photosensitive drums 1 from the transfer belt 5*a*, resulting in the downsizing of the image forming apparatus. The configuration causes the drawer member 60 to be operated in almost linear region, enhancing the operability of the drawer member 60.

Furthermore, in this exemplary embodiment, the driving path between the motor and the transfer belt 5*a* is disconnected when the door 15 is opened for operation of the drawer member 60. This prevents unwanted clogging of the drawer member 60 due to holding torque of the motor.

In this exemplary embodiment, the cone clutch mechanism has been described as the clutch mechanism for coupling/separation between the conical convex clutch surface 81*d* and the conical concave clutch surface 80*a*. One of or both of the convex clutch surface 81*d* and the concave clutch surface 80*a* may be provided with a rubber layer for ensuring the prevention of sliding.

The clutch mechanism of the present invention is not limited to the cone clutch mechanism described in this exemplary embodiment, and may be other clutch mechanism such as a flat plate clutch and a dog clutch. The clutch mechanism is used in the above description as a unit configured to switch a driving system, but the present invention is not limited to the clutch mechanism, and may use a rocking gear, instead of the clutch mechanism.

In this exemplary embodiment, the configuration with the transfer belt 5*a* as an intermediate transfer belt is described, but the mechanism of the present invention may be used in a configuration with a recording material conveyance member in the form of a belt for conveying recording material to image forming stations, instead of the transfer belt 5*a*.

In this exemplary embodiment, a user is supposed to operate the drawer member 60, but the present invention is not limited to this configuration, and may use a drive motor to operate the drawer member 60.

Figure 8A:
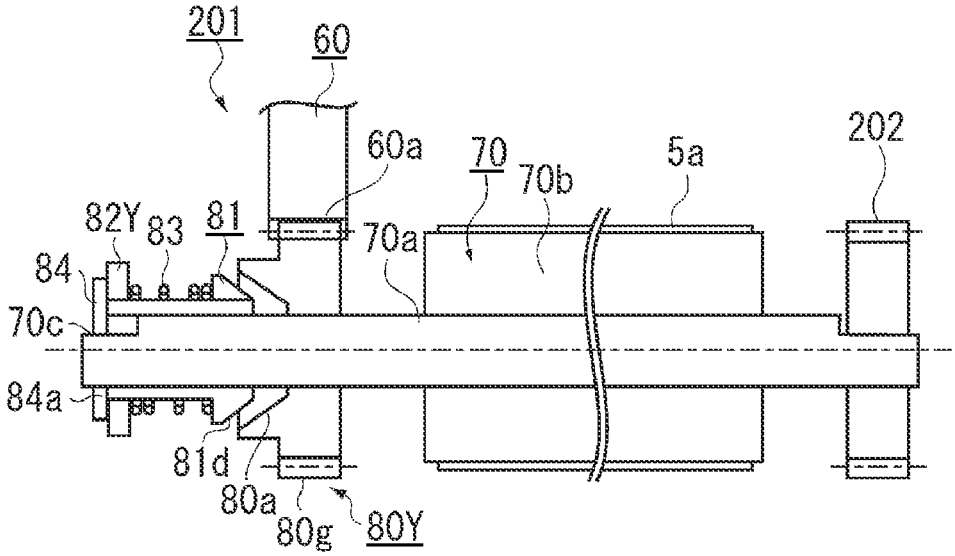
FIGS. 8A and 8B are longitudinal cross sectional views illustrating a transfer device of another exemplary embodiment.
Figure 8B:
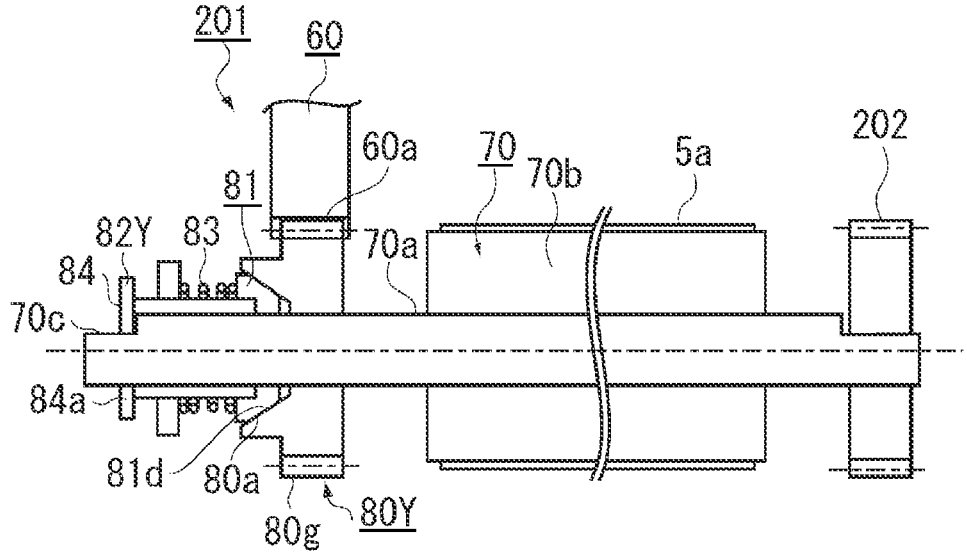

For example, as illustrated in FIGS. 8A and 8B, another configuration may be used so that a user can drive a motor by a predetermined amount according to an operation by the user via an operation panel (not illustrated). This configuration includes a transfer driving gear 202 that integrally rotates with the first suspension roller shaft 70*a* instead of the drive transmission clutch mechanism 200, and the first suspension roller shaft 70*a* is provided with a tray-coupling clutch 201 similar to that of this exemplary embodiment at the other end thereof, so that the tray-coupling clutch 201 is disengaged from the coupling clutch 201 when the door is closed as illustrated in FIG. 8A, and is coupled to the tray-coupling clutch 201 when the door is opened.

A second exemplary embodiment of the present invention is described below with reference to FIGS. 9A, 9B, 9C, and 9D.

Figure 9A:
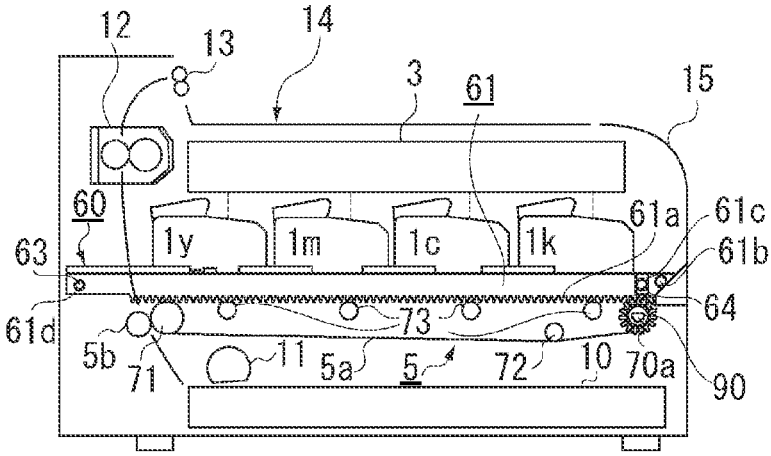
FIGS. 9A and 9B are partial cross sectional views illustrating an electrophotographic image forming apparatus according to a second exemplary embodiment.
Figure 9B:
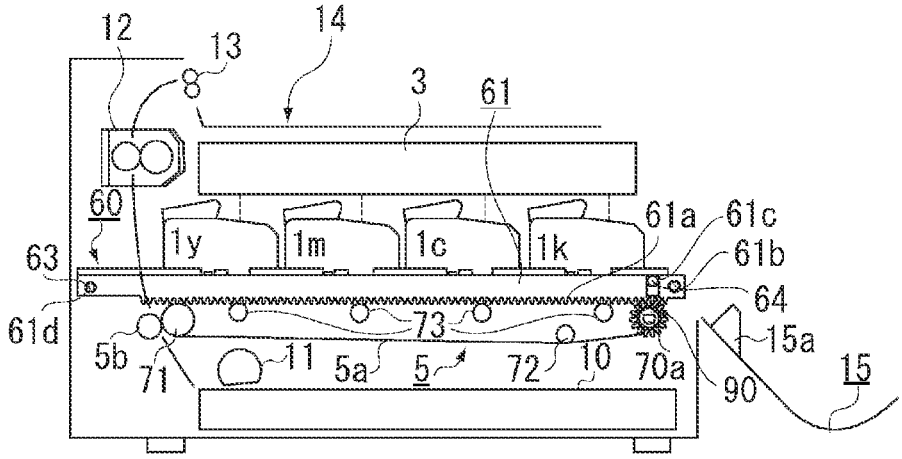
Figure 9C:
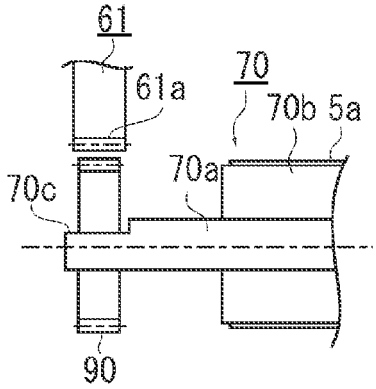
FIGS. 9C and 9D are longitudinal cross sectional views illustrating a transfer device.
Figure 9D:
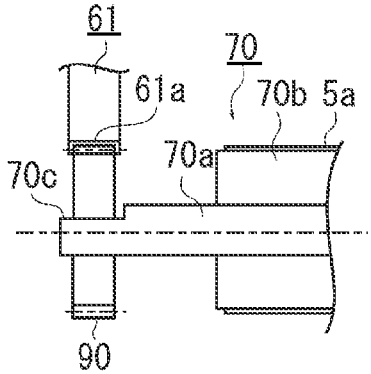

FIG. 9A is a partial cross sectional view illustrating an electrophotographic image forming apparatus with the door 15 being closed. FIG. 9B is a partial cross sectional view illustrating the electrophotographic image forming apparatus with the door 15 being opened. FIG. 9C is a longitudinal partial cross sectional view illustrating a transfer device with the door 15 being closed. FIG. 9D is a longitudinal partial cross sectional view illustrating the transfer device with the door 15 being opened.

The electrophotographic image forming apparatus according to the present exemplary embodiment includes as in the first exemplary embodiment, a drawer member 60 that is slidably held between inner and outer positions of the apparatus body and supports the process cartridges 50 (50*y*, 50*m*, 50*c*, 50*k*), and a transfer device 5 configured with a transfer belt 5*a*, a secondary transfer roller 5*b*, a first suspension roller 70, a second suspension roller 71, a tension roller 72, and primary transfer rollers 73 (73*y*, 73*m*, 73*c*, 73*k*). The first suspension roller 70 includes a first suspension roller shaft 70*a* and a rubber layer 70*b*.

The first suspension roller shaft 70*a* is provided with a driving mechanism similar to that of the first exemplary embodiment, at one end thereof (on the back side in FIGS. 9A and 9B, and the right side in FIGS. 9C and 9D), so that driving force is transmitted from a motor (not illustrated) for image formation.

The first suspension roller 70 is provided with a D-cut portion 70*c* at the other end thereof. The D-cut portion 70*c* has a coupling gear 90 that integrally rotates with the first suspension roller 70. The coupling gear 90 has a pitch radius that is almost equal to the sum of the radius of the rubber layer 70*b* of the first suspension roller 70 and the thickness of the transfer belt 5*a*.

The drawer member 60 is provided with a rack rotation shaft 63 and a rotation control pin 64 in combination, so that a rack member 61 is mounted thereto. The rack member 61 is provided with a rack portion 61*a*, a separation pin 61*b*, a rotation control hole 61*c*, and a pivot hole 61*d*.

The rack rotation shaft 63 is engaged with the pivot hole 61*d* of the rack member 61, and the rotation control pin 64 is engaged with the rotation control hole 61*c* of the rack member 61. The rack member 61 is biased clockwise by a bias unit (not illustrated) in FIGS. 9A, 9B, 9C, and 9D. In the clockwise rotation of the rack member 61 in FIGS. 9A, 9B, 9C, and 9D, the rack portion 61*a* of the rack member 61 is meshed with the coupling gear 90.

The door 15 is provided with a wedge 15*a*. The wedge 15*a* is engaged with the separation pin 61*b* of the rack member 61 while the door 15 is closed, and rotates the rack member 61 counter-clockwise in FIGS. 9A, 9B, 9C, and 9D. In the rotation, the rack portion 61*a* is completely separated from the coupling gear 90.

In image formation with the door 15 being closed, the first suspension roller 70 is driven by a motor for rotation, which in turn rotates the coupling gear 90. However, the coupling gear 90 slips due to the complete separation between the rack portion 61*a* and the coupling gear 90 (see FIGS. 9A and 9C).

When the door 15 is opened, the rack portion 61*a* is engaged with the coupling gear 90. Thus, through an operation of the drawer member 60 by a user, the rack portion 61*a* drives the coupling gear 90, and the transfer belt 5*a* is driven as in the first exemplary embodiment.

In summary, a configuration can be provided in which, while the supporting member (drawer) is sliding, a force is applied to rotate the endless belt as the supporting member (drawer) moves.

This achieves the reduction in difference, or almost eliminates the difference, between relative speeds of the supporting member (drawer) and the belt while the supporting member (drawer) is sliding. The reduction or elimination reduces or prevents the sliding wear of the photosensitive member and the belt even when the supporting member (drawer) slides while the photosensitive member and the belt are in contact with each other.

This eliminates the operation and space for separation between the photosensitive member and the belt to avoid damages thereon, resulting in downsizing of the apparatus. The supporting member is operated in almost linear region, which enhances the operability of the drawer.

In the above first and second examples, the process cartridges 50 are detachable from the drawer 60. However, the drawer 60 may directly support the photosensitive drums 1, and supports the development cartridge including the developing device 4 in a detachable manner. Alternatively, the photosensitive member cartridge with the photosensitive drums 1 and the development cartridge may be each mounted to the drawer 60 in a detachable manner.

In the above first and second examples, the intermediate transferring member is used as an endless belt in the above description, but as described above, a recording material conveyance member may be used instead.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-015416 filed Jan. 27, 2009, which is hereby incorporated by reference herein in its entirety.

What is claimed is:

1. An electrophotographic image forming apparatus for forming an image on a recording medium comprising:

an apparatus body having an endless belt incorporated therein configured to transfer toner images formed on a plurality of image bearing members to the recording medium; and a supporting member configured to support the plurality of image bearing members and to be slidable between inner and outer positions of the apparatus body along the arranged direction of the plurality of image bearing members, wherein when the supporting member slides between the inner and outer positions of the apparatus body while at least one of the plurality of image bearing members is in contact with the belt, a force is applied to the belt to rotate the belt along the moving direction of the supporting member, wherein when the supporting member slides between the inner and outer positions of the apparatus body, a first driving path is formed between the belt and the supporting member for the application of the force to the belt, and wherein when the supporting member is disposed at the inner position and the toner images are transferred to the recording medium, the first driving path is not formed.

2. The electrophotographic image forming apparatus according to claim 1, wherein the apparatus body includes a door that opens and closes an opening through which the supporting member passes to slide between the inner and outer positions of the apparatus body, and wherein while the door is opened, the first driving path is formed, and while the door is closed, the first driving path is not formed.

3. The electrophotographic image forming apparatus according to claim 1, wherein the first driving path is provided by a clutch mechanism.

4. The electrophotographic image forming apparatus according to claim 1, wherein when the supporting member is disposed at the inner position of the apparatus body and the belt causes the toner images to be transferred to the recording medium, a second driving path is formed between the belt and a motor to rotate the belt, and wherein when the supporting member slides between the inner and outer positions of the apparatus body, the second driving path is not formed.

5. The electrophotographic image forming apparatus according to claim 4, wherein the apparatus body includes a door that opens and closes an opening through which the supporting member passes to slide between the inner and outer positions of the apparatus body, and wherein while the door is closed, the second driving path is not formed, and while the door is opened, the second driving path is formed.

6. The electrophotographic image forming apparatus according to claim 4, wherein the second driving path is provided by a clutch mechanism.

7. The electrophotographic image forming apparatus according to claim 1, wherein when the supporting member slides between the inner and outer positions of the apparatus body, the supporting member moves at a speed approximately equal to that of the belt.

8. An electrophotographic image forming apparatus for forming an image on a recording medium comprising:

an apparatus body having an endless belt incorporated therein configured to transfer toner images formed on a plurality of image bearing members to the recording medium; and a supporting member configured to support the plurality of image bearing members and to be slidable between inner and outer positions of the apparatus body along the arranged direction of the plurality of image bearing members, wherein when the supporting member slides between the inner and outer positions of the apparatus body, the supporting member applies a force to the belt to rotate the belt along the moving direction of the supporting member.

9. The electrophotographic image forming apparatus according to claim 8, further comprising:

a driving force transmission member, wherein when the supporting member slides between the inner and outer positions of the apparatus body, the driving force transmission member transmits the force to the belt.

10. The electrophotographic image forming apparatus according to claim 9, wherein when the supporting member is disposed at the inner position and the toner images are transferred to the recording medium, the driving force transmission member prevents the force from being transmitted from the belt to the supporting member.

11. The electrophotographic image forming apparatus according to claim 10, further comprising:

a second driving force transmission member, wherein when the supporting member is disposed at the inner portion and the toner images are transferred to the recording medium, the second driving force transmission member transmits a driving force from a motor to the belt.

* * * * *